US005352374A

United States Patent [19]

Habeeb et al.

[11] Patent Number: 5,352,374

[45] **Date of Patent: * Oct. 4, 1994**

[54] LUBRICANT COMPOSITION CONTAINING ALKOXYLATED AMINE SALT OF A DIHYDROCARBYLDITHIOPHOSPHORIC ACID (LAW024)

[75] Inventors: Jacob J. Habeeb, Westfield; Ramon L. Espino, Califon; Elisavet P. Vrahopoulou, Chatham, all of N.J.

[73] Assignee: Exxon Research & Engineering Co., Florham Park, N.J.

[ * ] Notice: The portion of the term of this patent subsequent to Feb. 22, 2010 has been disclaimed.

[21] Appl. No.: 120,623

[22] Filed: Sep. 13, 1993

Related U.S. Application Data

[63] Continuation-in-part of Ser. No. 21,292, Feb. 22, 1993.

[51] Int. Cl.[5] ..... C10M 105/74

[52] U.S. Cl. ..... 252/32.7 R; 252/51.5 R

[58] Field of Search ..... 252/32.7 R, 515.5 R

[56] References Cited

U.S. PATENT DOCUMENTS

| | | | |
|---|---|---|---|
| 2,737,492 | 3/1956 | Beegle et al. | 252/32.7 |
| 3,769,211 | 10/1973 | Hamblin et al. | 252/32 FE |
| 3,997,454 | 12/1976 | Adams | 252/18 |
| 4,089,790 | 5/1978 | Adams | 252/18 |
| 4,132,657 | 1/1979 | Verdicchio et al. | 252/32.5 |
| 4,163,729 | 8/1979 | Adams | 252/18 |
| 4,244,827 | 1/1981 | Michaelis et al. | 252/46.4 |
| 4,557,845 | 12/1985 | Horodysky et al. | 252/49.9 |
| 4,575,431 | 3/1986 | Salentine | 252/32.7 E |
| 4,721,802 | 1/1988 | Forsberg | 558/207 |
| 4,774,351 | 9/1988 | Forsberg | 558/207 |
| 4,917,809 | 4/1990 | Zinke et al. | 252/32.7 E |
| 4,965,002 | 10/1990 | Brannen et al. | 252/32.5 |
| 5,059,299 | 10/1991 | Cody et al. | 208/27 |
| 5,080,813 | 1/1992 | Kammann et al. | 252/32.7 R |

*Primary Examiner*—Prince Willis, Jr.
*Assistant Examiner*—Cephia D. Toomer
*Attorney, Agent, or Firm*—James H. Takemoto

[57] ABSTRACT

A lubricating oil composition having improved antiwear, antioxidancy and fuel economy properties which comprises a hydroisomerized wax basestock and an alkoxylated amine salt of a dihydrocarbyldithiophosphoric acid of the formula

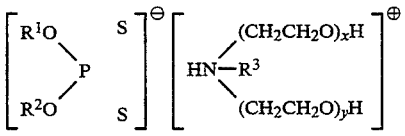

(I)

where $R^1$ and $R^2$ are each independently hydrocarbyl groups having from 3 to 30 carbon atoms, $R^3$ is a hydrocarbyl group of 2 to 22 carbon atoms, x and y are each independently integers from 1 to 15 with the proviso that the sum of x+y is from 2 to 20.

8 Claims, No Drawings

LUBRICANT COMPOSITION CONTAINING ALKOXYLATED AMINE SALT OF A DIHYDROCARBYLDITHIOPHOSPHORIC ACID (LAW024)

This application is a continuation-in-part of U.S. Ser. No. 021,292 filed Feb. 22, 1993.

BACKGROUND OF THE INVENTION

1. Field of the Invention

This invention relates to a lubricant composition containing an alkoxylated amine salt of a dihydrocarbyldithiophosphoric acid and its use to improve fuel economy in an internal combustion engine.

2. Description of the Related Art

In order to protect internal combustion engines from wear, engine lubricating oils have been provided with antiwear and antioxidant additives. The primary oil additive for the past 40 years for providing antiwear and antioxidant properties has been zinc dialkyldithiophosphate (ZDDP). For example, U.S. Pat. No. 4,575,431 discloses a lubricating oil additive composition containing dihydrocarbyl dithiophosphates and a sulfur-free of hydrocarbyl dihydrogen phosphates and dihydrocarbyl hydrogen phosphates, said composition being at least 50% neutralized by a hydrocarbyl amine having 10 to 30 carbons in said hydrocarbyl group. U.S. Pat. No. 4,089,790 discloses an extreme-pressure lubricating oil containing (1) hydrated potassium borate, (2) an antiwear agent selected from (a) ZDDP, (b) an ester, an amide or an amine salt of a dihydrocarbyl dithiophosphoric acid or (c) a zinc alkyl aryl sulfonate and (3) an oil-soluble organic sulfur compound.

Oil additive packages containing ZDDP have environmental drawbacks. ZDDP adds to engine deposits which can lead to increased oil consumption and emissions. Moreover, ZDDP is not ash-free. Various ashless oil additive packages have been developed recently due to such environmental concerns.

It would be desirable to have a lubricating oil additive which provides excellent antioxidant antiwear, fuel economy and environmentally beneficial (less fuel, i.e., less exhaust emissions) properties.

SUMMARY OF THE INVENTION

This invention relates to alkoxylated amine salts of dihydrocarbyldithiophosphoric acids in lubricating oils to improve fuel economy wear protection and antioxidancy of lubricating oils used in an internal combustion engine. The lubricating oil composition comprises a major amount of a hydroisomerized wax basestock wherein the hydroisomerized wax basestock has a viscosity index of at least 120, a pour point of −15° C. or lower and a viscosity of from 2 to 15 cSt at 100° C. and from about 0.02 wt % to about 0.40 wt % based on basestock of an alkoxylated amine salt of a dihydrocarbyldithiophosphoric acid, said salt having the formula

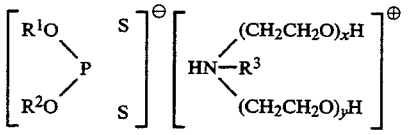

(I)

where $R^1$ and $R^2$ are each independently hydrocarbyl groups having from 3 to 30 carbon atoms, $R^3$ is a hydrocarbyl group having from 2 to 22 carbon atoms, and x and y are each independently integers of from 1 to 15 with the proviso that the sum of x+y is from 2 to 20. In another embodiment there is provided a method for improving fuel economy in an internal combustion engine which comprises operating the engine with lubricating oil containing an amount effective to improve fuel economy of an amine salt of the formula (I).

DETAILED DESCRIPTION OF THE INVENTION

In the lubricating oil composition of the present invention, the lubricating oil will contain a major amount of a lubricating oil basestock. The lubricating oil basestocks are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

A preferred synthetic oil is derived from the hydroisomerization of waxes under mild hydrorefining such as are described in U.S. Pat. No. 5,059,299. Such wax isomerate base oil is a mixture of isoparaffins and 1–6 ring naphthenes and contains randomly distributed methyl and ethyl side chains. The wax isomerate is, therefrom, highly paraffinic (CA 99.5% saturates). It exhibits higher thermal stability and higher inhibited oxidation stability relative to conventional basestocks. It also shows lower deposit and sludge forming tendencies and lower volatility. The high viscosity index of the isomerate base oil make it an excellent candidate for many engine and industrial lube applications. Preferred slack wax isomerates have a viscosity index of at least 130, a pour point of −21° C. or lower and a viscosity of from 3 to 10 cSt at 100° C.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The amine salts of dihydrocarbyldithiophosphoric acids are prepared from the reaction of alkoxylated, preferably propoxylated or ethoxylated, especially ethoxylated amines with dihydrocarbyldithiophosphoric acids. Preferred ethoxylated amines used to prepare amine salts have the formula

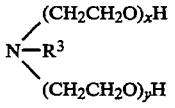

where $R^3$ is a hydrocarbyl group of from 2 to 22 carbon atoms, preferably 6 to 18 carbon atoms. The hydrocarbyl groups include aliphatic (alkyl or alkenyl) groups which may be substituted with hydroxy, mercapto and amino, and the hydrocarbyl group may be interrupted by oxygen, nitrogen or sulfur. The sum of x + y is preferably 2 to 15. Ethoxylated and/or propoxylated amines are commercially available from Sherex Chemicals under the trade name Varonic® and from Akzo Corporation under the trade names Ethomeen®, Ethoduomeen® and Propomeen®. Examples of preferred amines containing from 2 to 15 ethoxy groups include ethoxylated (5) cocoalkylamine, ethoxylated (2) tallowalkylamine, ethoxylated (15) cocoalkylamine and ethoxylated (5) soyaalkylamine.

Preferred dihydrocarbyldithiophosphoric acids used to react with alkoxylated amines to form amine salts have the formula

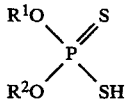

where $R^1$ and $R^2$ are independently hydrocarbyl groups having from 3 to 30 carbon atoms, preferably 3–20 carbon atoms. Such hydrocarbyl groups include aliphatic (alkyl or alkenyl) and alicyclic groups. The aliphatic and alicyclic groups may be substituted with hydroxy, alkoxy, cyano, nitro and the like and the alicyclic group may contain O, S or N as hetero atoms. Especially preferred are dialkyldithiophosphoric acid made from mixed (85%) 2-butyl alcohol and (15%) isooctylalcohol (mixed primary and secondary alcohols). Dihydrocarbyldithiophosphoric acids are commercially available from Exxon Chemical Company.

The amine salts are prepared by methods known to those skilled in the art. Approximately equimolar amounts of alkoxylated amine and dihydrocarbyldithiophosphoric acid are mixed together in an acid/base neutralization reaction. The amounts of acid or base may be varied to achieve the desired acid/base balance of the final amine salt.

The lubricant oil composition according to the invention comprises a major amount of lubricating oil basestock and an amount of amine salt effective to increase fuel economy. Typically, the amount of amine salt will be from about 0.1 wt % to about 5.0 wt %, based on oil basestock. Preferably, the amount of amine salt is from about 0.5 wt % to about 2.0 wt %. If the lubricating oil basestock is a hydroisomerized wax, the amount of amine salt can be reduced to about 0.02 to about 0.40 wt % preferably about 0.05 to about 0.25 wt %, based on oil basestock. This reflects a synergistic effect between the amine salts and the hydroisomerized wax basestock.

If desired, other additives known in the art may be added to the lubricating oil basestock. Such additives include dispersants, other antiwear agents, other antioxidants, corrosion inhibitors, detergents, pour point depressants, extreme pressure additives, viscosity index improvers, friction modifiers, and the like. These additives are typically disclosed, for example in "Lubricant Additives" by C. V. Smalhear and R. Kennedy Smith, 1967, pp. 1–11 and in U.S. Pat. No. 4,105,571, the disclosures of which are incorporated herein by reference.

The lubricating oil composition of the invention is further illustrated by the following examples which also illustrate a preferred embodiment.

EXAMPLE 1

Synthesis of Amine Salt 350 g of ethoxylated(5)cocoalkylamine was placed in a 3-neck round bottom flask fitted with a thermometer and a water cooled condenser. The amine was stirred and heated to 50° C. A stoichiometric amount of dioctyldithiophosphoric acid was then slowly titrated into the warm amine solution with stirring. The temperature was raised to 95° C. for 2 hours. The neutralization reaction was monitored with a pH meter. The addition of the acid was stopped at pH 7. After 2 hours of stirring at 95° C. the reaction product was cooled to room temperature and used without further purification.

EXAMPLE 2

This example demonstrates that a hydroisomerized wax basestock and the amine salt according to the invention are highly effective friction modifiers as compared to a conventional mineral oil basestock. The hydroisomerized wax basestock is a slack wax isomerate prepared according to the method described in U.S. Pat. No. 5,059,299 and having the following properties: viscosity index 142, pour point −21° C. and viscosity of 5.8 cSt at 100° C.

The Ball on Cylinder (BOC) friction tests were performed using the experimental procedure described by S. Jahanmir and M. Beltzer in ASLE Transactions, Vol. 29, No. 3, p. 425 (1985) using a force of 0.8 Newtons (1 Kg) applied to a 12.5 mm stell ball in contact with a rotating steel cylinder that has a 43.9 mm diameter. The cylinder rotates inside a cup containing a sufficient quantity of lubricating oil to cover 2 mm of the bottom of the cylinder. The cylinder was rotated at 0.25 RPM. The friction force was continuously monitored by means of a load transducer. In the tests conducted, friction coefficients attained steady state values after 7 to 10 turns of the cylinder. Friction experiments were conducted with an oil temperature of 100° C. Various amounts of ethoxylated amine salt prepared in Example 1 were added to solvent 150 N and slack wax isomerate. The results of BOC friction tests are shown in Table 2.

TABLE 2

| Wt % of Ethoxylated Amine Salt in Basestocks | Coefficient of Friction: Mineral S150N* | Coefficient of Friction: Slack Wax Isomerate |
|---|---|---|
| 0.0 | 0.45 | 0.37 |
| 0.05 | 0.45 | 0.075 |
| 0.10 | 0.25 | 0.075 |
| 0.20 | 0.24 | 0.075 |
| 0.30 | 0.10 | 0.060 |
| 0.50 | 0.10 | 0.075 |
| 0.80 | 0.08 | 0.060 |
| 1.00 | 0.075 | 0.060 |

*S150 is a solvent extracted, dewaxed, hydrofined neutral lube base stock obtained from approved paraffinic crudes (viscosity, 32 cSt at 40° C., 150 Saybolt seconds).

The data in Table 2 demonstrates that the ethoxylated amine salt in the slack wax isomerate basestock produced a low coefficient of friction even at concentrations of 0.05 wt % whereas the same amount in a conventional mineral oil basestock showed no change in friction coefficient over the basestock with no added amine salt. This reflects a synergistic interaction between the amine salts and the hydroisomerized wax.

What is claimed is:

1. A lubricating oil composition comprising:

(a) a hydroisomerized wax basestock wherein the hydroisomerized basestock has a viscosity index of at least 120, a pour point of −15° C. or lower and a viscosity of from 2 to 15 cSt at 100° C., and (b) from about 0.02 wt % to about 0.40 wt %, based on basestock of an ethoxylated amine salt of a dihydrocarbyldithiophosphoric acid, said salt having the formula

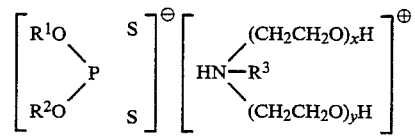

(I)

where $R^1$ and $R^2$ are each independently hydrocarbyl groups having from 3 to 30 carbon atoms, $R^3$ is a hydrocarbyl group of 2 to 22 carbon atoms, and x and y are each independently integers from 1 to 15 with the proviso that the sum of x+y is from 2 to 20.

2. The composition of claim 1 wherein $R^3$ is alkyl or alkenyl of 6 to 18 carbon atoms.

3. The composition of claim 1 wherein the sum of x+y is from 2 to 15.

4. The composition of claim 1 wherein the amount of amine salt is from about 0.05 to about 0.25 wt %, based on basestock.

5. The composition of claim 1 wherein $R^3$ is substituted with OH, SH or $NH_2$ on the terminal carbon atom of the hydrocarbyl group.

6. The composition of claim 1 wherein $R^1$ and $R^2$ are alkyl or alkenyl of from 3 to 20 carbon atoms.

7. The composition of claim 1, wherein the hydroisomerized wax basestock is a slack wax isomerate.

8. A method for improving fuel economy of an internal combustion engine which comprises operating the engine with a lubricating oil composition containing an amount effective to improve fuel economy of the amine salt of claim 1.

* * * * *